US005099659A

United States Patent [19]

Carranza et al.

[11] Patent Number: 5,099,659

[45] Date of Patent: Mar. 31, 1992

[54] MAGNETIC JEWELRY CLASP

[75] Inventors: Victor Carranza, New York, N.Y.; Reinhold M.W. Strnat, Dayton, Ohio

[73] Assignee: Idylls Ltd., New York, N.Y.

[21] Appl. No.: 405,999

[22] Filed: Sep. 12, 1989

[51] Int. Cl.[5] ..... A44C 25/00

[52] U.S. Cl. ..... 63/2; 24/303

[58] Field of Search ..... 63/2, 14.1, 12; 24/303, 24/116 A; 70/459; 40/1.5

[56] References Cited

U.S. PATENT DOCUMENTS

| | | | |
|---|---|---|---|
| 2,803,953 | 8/1957 | Zubalik | 24/303 X |
| 2,975,497 | 3/1961 | Budreck | 24/303 |
| 3,034,320 | 5/1962 | Fiebelman | 63/14.1 |
| 3,111,736 | 11/1963 | Budreck | 70/459 X |
| 4,480,361 | 11/1984 | Morita | 44/303 |

*Primary Examiner*—Kenneth J. Dorner
*Assistant Examiner*—J. Bonifanti
*Attorney, Agent, or Firm*—Sughrue, Mion, Zinn, Macpeak & Seas

[57] ABSTRACT

A magnetic clasp having first and second magnetized portions, each with a hole disposed in the center thereof. The two portions are magnetically attractive to each other but are divided with a gap at their interface to permit easy separation thereof. A third magnetic portion is sized to fit within the hole in the first and second rings. The magnetic prevents lateral movement of the two portions at their interface. The male portion has attached to its opposite ends a chain, each end of the chain being further attached to a stop sized larger than the hole in the rings.

13 Claims, 2 Drawing Sheets

FIG. 1
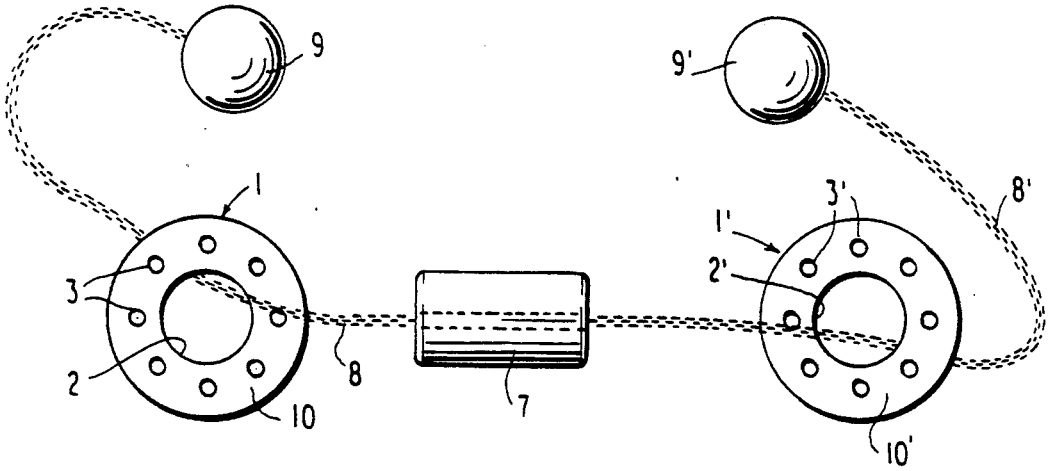
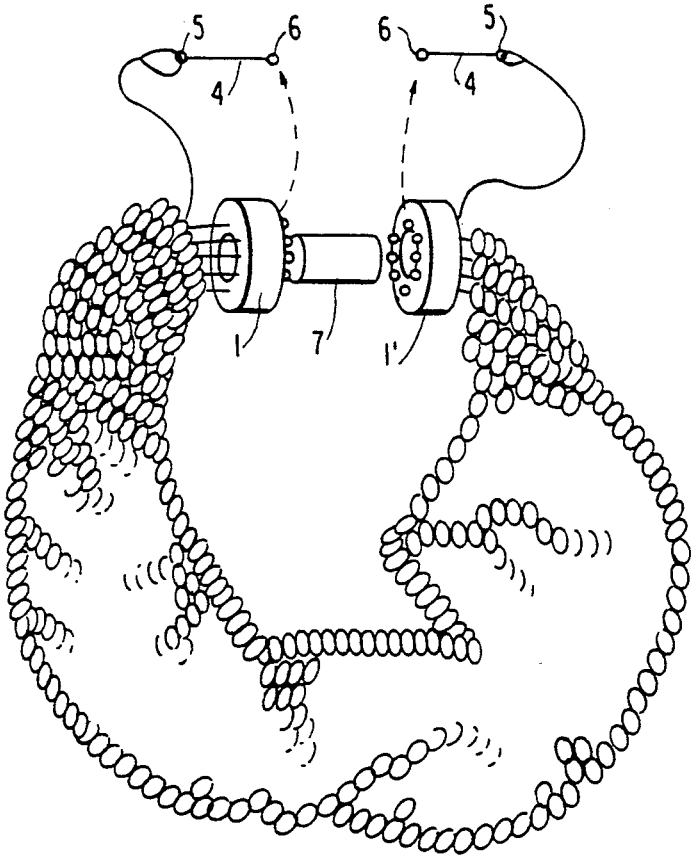
FIG. 2
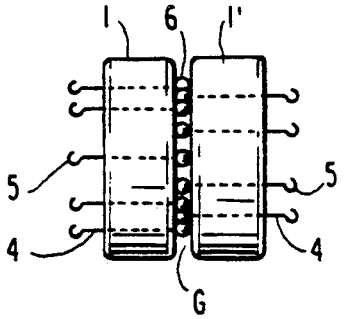
FIG. 3

MAGNETIC JEWELRY CLASP

BACKGROUND

Jewelry and other objects often require a device that allows two ends of the object to be repeatedly fastened and unfastened. The object, if a necklace or bracelet, requires two ends of the object to be fastened so that it can be secured around the neck or wrist of the wearer. If an earring or pin, the object must be capable of securing between two ends, a piece of clothing, an ear lobe, and the like. A device that is able to fasten the opposite ends of such objects may be called a clasp. Various methods exist for forming this clasping device. One well known and popular method uses a mechanical clasp.

An alternate method is to use a magnetic force to form the clasp. In such a method, two magnets are fastened to opposing ends of a piece of jewelry. Each magnet has a north and a south pole. Preferably, the south pole face of one magnet and the north pole face of the other magnet form the clasp interface. When the magnets are brought together, the attractive magnetic force of the opposing north and south pole faces forms the clasp. The attractive force of these clasps is strongest in the direction perpendicular to the interface region where the two clasp magnets come into contact. The magnetic force in the direction parallel to the interface area is much weaker.

Because of this significant difference in the amount of attractive force at the interface between two magnets that form a clasp, it has been found that conventional magnetic clasps are difficult to open because of the strong magnetic force that exists in a direction perpendicular to this interface.

As seen in the prior art patents to Hornick U.S. Pat. No. 2,615,227 and Fujimoto U.S. Pat. No. 4,231,137, magnetic clasps may have opposing male and female pieces to provide a mechanical resistance to the application of a force in a direction parallel to the clasp interface. In such a method, small forces parallel to the interface will not separate the clasp. However, these prior art mating clasp structures suffer from the disadvantage that they cannot prevent the separation of the clasp due to a force in any direction in the plane of the clasp interface. Ordinarily, the mechanical resistance is to a force in only one direction.

Further, conventional magnetic clasps do not provide adequate safety mechanisms to guard against loss of the jewelry, should the clasp accidentally release.

SUMMARY OF THE INVENTION

A first object of this invention is to provide a magnetic clasp with a high coupling force that is nevertheless easy for the user to separate.

A second object of this invention is to provide a magnetic clasp with multiple locations for the attachment of jewelry so that the clasp may sufficiently accommodate large pieces of jewelry.

A third object of this invention is to provide a magnetic clasp with a mechanical connection that prevents small lateral forces in any direction parallel to the interface of the magnetic clasp elements from causing the clasp to release.

Another object of the invention is to provide a single integral clasp unit such that parts of the clasp will not become separated from one another.

Still a further object of the invention is to provide a safety device inherent in the single integral clasp such that the safety device prevents a necklace or bracelet from falling off should the clasp accidentally release.

These and other objects, which will become apparent from the ensuing description of the preferred embodiment, are accomplished according to the present invention.

BRIEF DESCRIPTION OF THE DRAWINGS

FIG. 1 illustrates an unfastened clasp, in one preferred embodiment of the invention, without jewelry attached thereto.

FIG. 2 is a drawing of the clasp of FIG. 1 further illustrating the manner in which the jewelry is attached.

FIG. 3 illustrates the clasp of FIG. 2 in the clasped position, without the attached jewelry.

DESCRIPTION OF THE PREFERRED EMBODIMENT

Figure 4:
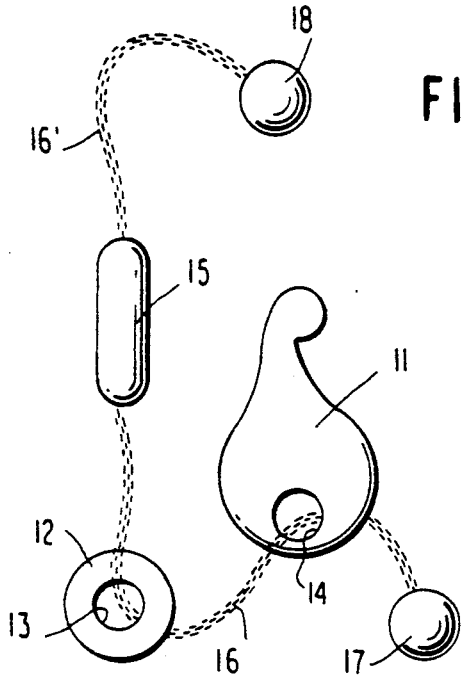
FIG. 4 is a drawing of the clasp wherein one of the clasp pieces is a piece of jewelry.

One preferred embodiment of the magnetized clasp of the present invention is shown in FIGS. 1, 2, and 3. The clasp comprises two circular magnetized female portions 1, 1' each having an axial through hole 2, 2'. One face 10 of female portion 1 has one polarity (i.e. North) while the other face 10' of female portion 1' has the opposite polarity (i.e. South). Located axially around said through holes 2, 2' are a plurality of smaller, connection holes 3, 3' through which spindles 4 are placed. Integral with each spindle 4 is a hook 5 to which the jewelry is fastened. After each of the spindles is inserted into each of the connection holes, a ball 6 is attached to an end of each of the spindles 4 to prevent the hooks 5 and spindles 4 from sliding out of the connection holes 3. Further, the balls serve another function. When the female portions 1, 1' are brought into proximity with one another, forming an interface that is maintained by the magnetic attraction of the oppositely polarized surfaces 10, 10' of the clasp, the balls 6 prevent the female portions 1 from directly contacting one another. The resulting gap G, as seen in FIG. 3, is sized to reduce the strength of the clasp magnetic attraction somewhat and permits the insertion of a fingernail so that the clasp can be unfastened easily, yet to maintain enough strength from the magnetic attraction to assure adequate holding.

The magnetic clasp relies on the attractive force of the female portions 1, 1', which is strongest in a direction perpendicular to the interface between opposite pole forms the female portions. Because of this form, the clasp is unlikely to accidentally release in the perpendicular direction. However, the magnetic force developed parallel to the clasp interface is substantially weaker. Thus, it is much more likely that the female portions 1, 1' of the clasp would slide apart in a direction parallel to the interface. To reduce the ability of a small lateral force, parallel to the interface, to accidentally release the clasp, the balls 6 of each female portion are aligned to occupy adjacent positions when the clasp is fastened. In this manner the balls provide a mechanical resistance to any small lateral force.

However, since a large force, parallel to the interface, could still separate the two clasp portions 1, 1' a male plug 7 is inserted into the through holes 2, 2' of each of the female portions 1, 1' when the female portions 1, 1' have been brought together to form the clasp. The male plug 7 is sized to fit closely within the through holes 2, 2' and keep the female portions 1, 1' from sliding parallel to the interface. Thus, the clasp is only separable in a direction perpendicular to the interface.

Figure 7:
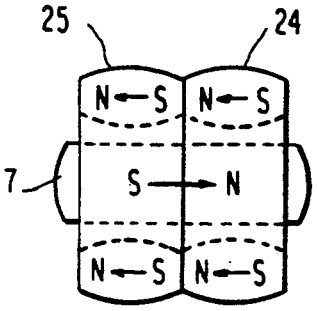
FIG. 7 illustrates the orientation of the magnetic male plug that produces an attractive force with the female pieces.

The male plug 7 may be made of a magnetic material and may have North and South poles at its opposite ends. The plug is inserted into the through holes 2, 2' when the female portions 1, 1' are in the clasped position. The plug 7 is oriented such that the North pole of the plug is adjacent to the female portion whose outer surface has a South polarity. Consequently, the opposite end of the plug, having a South polarity is opposite the female portion having an outer surface with a North polarity, as shown in FIG. 7. In this arrangement, the plug initially experiences a repelling force as it approaches the through holes 2, 2'. As the plug 7 is moved closer to the through holes 2, 2' the repelling force changes to a strong attractive force which draws the male plug into the through hole. The plug quickly reaches an equilibrium point, substantially centered within the through holes 2, 2'. Attempts to move the plug 7 from this equilibrium point result in a strong magnetic force between the plug and the female portions that forces the plug back toward the equilibrium point. The magnetic force acts as a safety mechanism, opposing any force attempting to remove the male plug and it is therefore unlikely that the male plug will accidentally be forced from the through holes 2, 2'.

Integral to the male plug 7 are chains 8, 8' and balls 9, 9' that function as a safety mechanism. Together with female portions 1, 1', they create a single, integral clasp that is secure against accidental separation. The balls 9, 9' are attached to the ends of the chain 8, 8'. Each of their diameters is larger than the diameter of the through holes 2, 2' of the female portions. The chains 8, 8' are secured to the male plug 7 and are threaded through the through holes 2, 2' of each female portion, as shown in FIG. 1, such that each female portion 1, 1' may slide over its respective chain 8, 8' and male plug 7. However, since each of the ball's diameters is larger than the diameter of each of the female portion's through holes 2, 2' each female portion 1, 1' is prevented from sliding over its respective ball 9, 9'. Therefore the chains 8, 8' and balls 9, 9' arrangement prevents the female portions 1, 1' from separating a distance farther than the length of the chain. This structure acts as a safety mechanism, preventing the jewelry from falling off the wearer should the clasp accidentally release.

Figure 5:
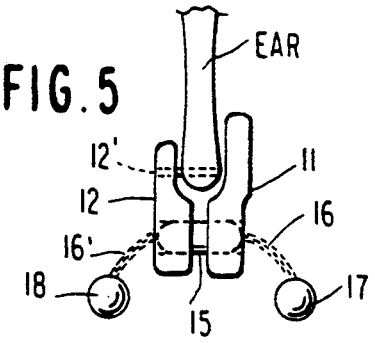
FIG. 5 is a detailed drawing of the jewelry of FIG. 4 illustrating the interface surface shaped to accommodate an earlobe.

An alternative embodiment, one used for earrings, is shown in FIGS. 4 and 5. In this embodiment an earring 11 is constructed at least in part of a magnetic material and corresponds to one of the female portions of the prior embodiment of the clasp. The other female portion 12 is a magnetic piece similar to the female portion of the previous embodiment except that here the female portion 12 has no connection holes. Similar to the previous embodiment, an axial through hole 13 is provided in the female portion 12. A corresponding through hole 14 is located in the earring. The earring 11 is placed on the front of the earlobe and the female portion 12 is placed behind the earlobe such that the through hole 13 of the female portion and the earring hole 14 are aligned beneath the earlobe.

The magnetic poles of each piece 11, 12 are oriented so that there are opposite poles at the interface. The magnetic attraction of the two pieces 11, 12 is strong in the direction perpendicular to the interface and will pinch the earring onto the earlobe. The pieces 11, 12 can be shaped to accommodate the earlobe and to enhance the leverage of the pinching force on the ear, as shown in FIG. 5. In addition, each piece can have a post 12 extending through a hole in the earlobe ordinarily used for pierced earrings.

As in the previous embodiment, a magnetic male plug 15 is used to prevent lateral forces from releasing the clasp. The male plug 15 is placed through the aligned through hole 13 and earring hole 14 beneath the earlobe. Attached to each end of the male plug 15 are chains 16, 16'. On an end of each chain 16, 16' is attached a ball 17, 18 respectively, with a diameter larger than the diameter of the through hole 13 of the female portion and the earring hole 14. The chain 16 is threaded through the through hole 13 of the female portion 12 and the earring hole 14, as shown in FIG. 4, such that the female portion 12 and earring 11 may slide over the chains 16, 16' and the male plug 15 but will not slide over the balls 17, 18. Thus, because the balls 17, 18 do not fit through the through hole 13 or the earring hole 14 the pieces form one integral earring the parts of which cannot be separated from one another.

Figure 6A:
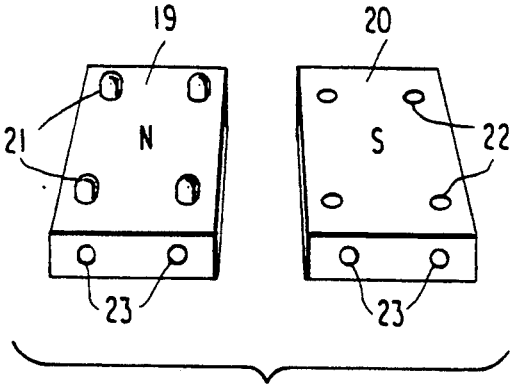
FIGS. 6A and 6B illustrate alternative embodiments of the clasp without jewelry attached.

Another alternate embodiment of the invention is a clasp for a bracelet or necklace, as illustrated in FIG. 6A. Referring to FIG. 6A, the clasp comprises a male piece 19 and a female piece 20. Two connection blind holes 23 are provided on an edge of the male piece 19 and on an edge of the female piece 20 to attach the jewelry.

As described above, the magnetic force in a direction perpendicular to the interface (resulting from the N-S pole attraction at the interface when pieces 19 and 20 are joined) is strong, while the magnetic force parallel to the interface is much weaker. Thus, to prevent lateral disengagement of the male and female pieces, the male piece 19 is provided with four mounded protrusions 21 rising from a surface of the magnet. The female piece 20 has indentations 22 corresponding to the protrusions 21 of the male piece 19. The protrusions 21 of the male piece 19 fit into the indentations 22 of the female piece 20 and prevent the clasp from accidentally releasing due to a lateral force, parallel to the interface.

Further, the four protrusions 21 are slightly higher than the corresponding depth of the indentations 22 on the female piece 20, so that there is a small gap between the male and female pieces, similar to that in FIG. 3. Alternatively, the diameter of the protrusions 21 may be made slightly larger than the diameter of the corresponding indentations 22 to accomplish the same result. The small gap permits the clasp to be unhooked easily without significantly reducing the magnetic clasp strength, and without increasing the likelihood of an accidental release.

Figure 6B:
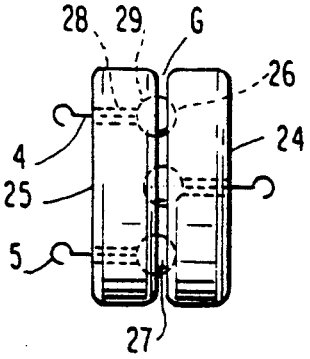

An alternative embodiment is shown in cross section in FIG. 6B. Two female pieces 24 and 25, having correspondingly located indentations 26, 29 form an opposing pair, are brought together to form the clasp. A plurality of third pieces 27 may be placed, permanently or temporarily, in one of each pair of indentations. The resulting mechanical link between the female portions 24 and 25 and the third pieces 27 acts to inhibit the accidental release of the clasp due to a lateral force, parallel to the interface. Moreover the third pieces are sized with respect to the indentation with which it is paired to provide a gap for easy opening of the clasp, as previously discussed.

The jewelry may be attached as shown in FIG. 6B. Connection holes 28 are drilled from the female indentations 29 to an outer surface of the female pieces 24 and 25. Spindles 4 having a connection hook 5 integral thereto are placed through each of the connection holes 28 and attached to the third pieces 27 so that the hook prevents the spindle from sliding out of the connection hole 28 in one direction and the third piece 27 prevents the spindle 4 from sliding out of the connection hole 28 in the opposite direction. In this manner, by attaching the jewelry to the hooks 5, the clasp is attached to the jewelry. Also the spindles 4, hooks 5, and attached third pieces 27 become attached to one or the other of the female pieces 24, 25 thus reducing the risk of their loss.

While several embodiments are described herein and illustrated in the drawings, the invention is not limited thereto. Various changes to these embodiments may be made that, nevertheless, fall within the scope of the appended claims.

What is claimed:

1. A magnetic clasp for fastening jewelry comprising:
a plurality of magnetic clasp portions defining at least one magnetic interface having a strong magnetic attraction in a direction normal to said interface;
means for fastening said jewelry to said magnetic clasp portions;
means passing through said interface engaging said clasp portions for providing a mechanical resistance to the separation of said portions by a force parallel to said interface; and
a plurality of protrusion means at said interface for establishing a gap between said portions for reducing the effort required to release said clasp.

2. The magnetic clasp of claim 1 wherein said plurality of magnetic clasp portions comprises:
a first clasp portion, said first clasp portion comprising a magnet having a north and south polarity, and an interface surface structure comprising at least a portion of said magnet with said north polarity; and
a second clasp portion, said second clasp portion comprising a magnet having a north and south polarity, and an interface surface structure comprising at least a portion of said magnet with said south polarity.

3. A magnetic clasp for fastening jewelry comprising:
a plurality of magnetic clasp portions defining at least one magnetic interface having a strong magnetic attraction in a direction normal to said interface;
means for fastening said jewelry to said magnetic clasp portions;
means at said interface for providing a mechanical resistance to the separation of said portions by a force parallel to said interface; and
means at said one interface for establishing a gap between said portions for reducing the effort required to release said clasp;
wherein said plurality of magnetic clasp portions comprises:
a first clasp portion, said first clasp portion comprising a magnet having a north and south polarity, and an interface surface structure comprising at least a portion of said magnet with said north polarity; and
a second clasp portion, said second clasp portion comprising a magnet having a north and south polarity, and an interface surface structure comprising at least a portion of said magnet with said south polarity; and
wherein said interface surface structure of one of said first and second clasp portions comprises male protrusion means and the interface surface of the other of said clasp portions comprises female receptor means, said male and female means being aligned and sized so that when said interface surfaces are joined by magnetic force, a gap is established at the interface and said mated male and female portions act to mechanically prevent a separation of said portions by a force in any direction parallel to said joined interface surface structures.

4. A magnetic clasp for fastening jewelry comprising:
a plurality of magnetic clasp portions defining at least one magnetic interface having a strong magnetic attraction in a direction normal to said interface;
means for fastening said jewelry to said magnetic clasp portions;
means at said interface for providing a mechanical resistance to the separation of said portions by a force parallel to said interface; and
means at said one interface for establishing a gap between said portions for reducing the effort required to release said clasp;
wherein said plurality of magnetic clasp portions comprises:
a first clasp portion, said first clasp portion comprising a magnet having a north and south polarity, and an interface surface structure comprising at least a portion of said magnet with said north polarity; and
a second clasp portion, said second clasp portion comprising a magnet having a north and south polarity, and an interface surface structure comprising at least a portion of said magnet with said south polarity; and
wherein said interface surface structure of each of said first and second clasp portions comprises:
a female receptor means, each of said female receptor means on said first and second clasp portions being aligned; and
a plurality of third clasp portions, said portions sized corresponding to said female receptor means such that when the interface surfaces are joined by magnetic force with said third clasp portions placed within said female receptor means, a gap is established at the interface and said mated first, second and third clasp portions act to mechanically prevent a separation of said portions by a force in any direction parallel to said joined interface surface structures.

5. The magnetic clasp of claim 3 or 4 wherein said means for fastening jewelry to said magnetic clasp portions comprises a plurality of blind holes on an edge of said magnetic clasp portions, the jewelry being fastened to said blind holes.

6. The magnetic clasp of claim 4 wherein said means for fastening jewelry to said magnetic clasp portions comprising:
a plurality of through holes located on each of said first and second magnetic clasp portions emanating from said female receptor means and going through to a surface other than the interface surface;

a plurality of elongated connection members each having a diameter along the elongated axis which is smaller than the diameter of said through holes, said connection members comprising an integral hook for fastening jewelry thereto, said integral hook having a diameter larger than said through hole;

each of said connection members having the end opposite said integral hook placed through said through holes on each of said first and second magnetic clasp portions from a surface other than the interface surface, and each of said ends being attached to one of said plurality of third clasp portions.

7. A magnetic clasp for fastening jewelry comprising:

a plurality of magnetic clasp portions defining at least one magnetic interface having a strong magnetic attraction in a direction normal to said interface; and means for fastening said jewelry to said magnetic clasp portions;

means at said interface for providing a mechanical resistance to the separation of said portions by a force parallel to said interface; and means at said one interface for establishing a gap between said portions for reducing the effort required to release said clasp;

wherein said plurality of magnetic clasp portions comprises:

a first clasp portion, said first clasp portion comprising a magnet having a north and south polarity, and an interface surface structure comprising at least a portion of said magnet with said north polarity;

a second clasp portion, said second clasp portion comprising a magnet having a north and south polarity, and an interface surface structure comprising at least a portion of said magnet with said south polarity; and a third magnetic clasp portion, said portion comprising a magnet with a north and south polarity; and, wherein said first and second clasp portions each comprises a through hole located on each of said first and second clasp portions at said interface surface and being aligned and sized so that when said interface surfaces are joined by magnetic force, said third magnetic clasp portion fits within said aligned through holes for mechanically preventing a separation of said portions by a force in any direction parallel to said joined interface surface structures.

8. The magnetic clasp of claim 7 further comprising a safety means for preventing the loss of the jewelry in the event that the clasp accidentally releases, said safety means comprising:

a first flexible safety member, said first safety member having a diameter smaller than said through holes and being attached to an end of said third magnetic clasp portion;

a second flexible safety member, said second safety member having a diameter smaller than the through holes and being attached to an end of the third magnetic clasp portion opposite the point of attachment of said first flexible safety member;

said first flexible safety member being threaded through said first magnetic clasp portion and attached to a first safety stop, said first safety stop having a cross-section greater then the cross-section of said through holes and being attached to an end of said first flexible safety member opposite the end attached to said third magnetic clasp portion; and said second flexible safety member being threaded through said second magnetic clasp portion and attached to a second safety stop, said second stop having a cross-section larger than the cross-section of said through holes and being attached to said second flexible safety members.

9. A magnetic clasp structured for use on earrings comprising:

a plurality of magnetic clasp portions defining at least one magnetic interface having a strong magnetic attraction in a direction normal to said interface;

means for fastening said jewelry to said magnetic clasp portions;

means at said interface for providing a mechanical resistance to the separation of said portions by a force parallel to said interface; and means at said one interface for establishing a gap between said portions for reducing the effort required to release said clasp;

wherein said plurality of magnetic clasp portions comprises:

a first clasp portion, said first clasp portion comprising a magnet having a north and south polarity, and an interface surface structure comprising at least a portion of said magnet with said north polarity; and a second clasp portion, said second clasp portion comprising a magnet having a north and south polarity, and an interface surface structure comprising at least a portion of said magnet with said south polarity, at least one of said first and second magnetic clasp portions further comprising an ornamental portion; and the interface defined by said first and second magnetic clasp portions comprises a surface structure shaped for accommodating an earlobe and for maximizing a pinching force derived from said attractive magnetic force at said interface surface.

10. The magnetic clasp of claim 9 further comprising:

a third magnetic clasp portion, said portion comprising a magnet with a north and south polarity; and wherein said first and second clasp portions each comprises a through hole located on each of said first and second clasp portions at said interface surface and being aligned beneath the earlobe and sized so that when said interface surfaces are joined by magnetic force, said third magnetic clasp portion fits within said aligned through holes beneath the earlobe for mechanically preventing a separation of said portions by a force in any direction parallel to said joined interface surface structures, said third magnetic clasp portion is placeable within said through holes such that said north pole of said third magnetic portion is adjacent to said south pole on said first clasp portion and said south pole on said third magnetic clasp portion is adjacent to said north pole on said second clasp portion such that an attractive magnetic force holds the third magnetic clasp portion within the through holes and resists movement of said third magnetic portion.

11. The magnetic clasp of claim 10 further comprising a safety means for preventing the separation of one part of the earring from the remaining parts in the event that the clasp accidentally releases, said safety means comprising:

a first flexible safety member, said first safety member having a diameter smaller than said through holes and being attached to an end of said third magnetic clasp portion;

a second flexible safety member, said second safety member having a diameter smaller than the through holes and being attached to an end of the third magnetic clasp portion opposite the point of attachment of said first flexible safety member;

said first flexible safety member being threaded through said first magnetic clasp portion and attached to a first safety stop. said first safety stop having a cross-section greater then the cross-section of said through holes and being attached to an end of said first flexible safety member opposite the end attached to said third magnetic clasp portion; and said second flexible safety member being threaded through said second magnetic clasp portion and attached to a second safety stop, said second stop having a cross-section larger than the cross-section of said through holes and being attached to said cross-section of said through holes and being attached to said second flexible safety members.

12. The earring of claim 11 further comprising a post, said post positioned on said first or second magnetic clasp portions such that it may be aligned with a hole in the earlobe generally used for pierced earrings, said post being placed through said pierced ear hole.

13. The magnetic clasp of claims 7 or 10 wherein said third magnetic clasp portion is placeable within said through holes such that said north pole of said third magnetic portion is adjacent to said south pole on said first clasp portion and said south pole on said third magnetic clasp portion is adjacent to said north pole on said second clasp portion such that an attractive magnetic force holds the third magnetic clasp portion within the through holes and resists movement of said third magnetic portion.

* * * * *